US009908660B2

(12) United States Patent
James et al.

(10) Patent No.: US 9,908,660 B2
(45) **Date of Patent: *Mar. 6, 2018**

(54) BLANK AND METHODS OF CONSTRUCTING A CONTAINER FROM THE BLANK

(71) Applicant: WestRock Shared Services, LLC, Norcross, GA (US)

(72) Inventors: Jeffrey Scott James, Elmhurst, IL (US); Jory B. Mack, Village of Lakewood, IL (US); Timothy A. Tripp, Kansas City, MO (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/184,147

(22) Filed: Jun. 16, 2016

(65) Prior Publication Data

US 2016/0297563 A1 Oct. 13, 2016

Related U.S. Application Data

(63) Continuation of application No. 14/717,541, filed on May 20, 2015, now Pat. No. 9,415,895, which is a (Continued)

(51) Int. Cl.
*B65D 5/66* (2006.01)
*B31B 3/00* (2006.01)
(Continued)

(52) U.S. Cl.
CPC ..... *B65D 5/6664* (2013.01); *B65D 5/20* (2013.01); *B65D 5/2019* (2013.01); *B65D 5/2033* (2013.01); *B65D 5/2052* (2013.01); *B65D 5/2057* (2013.01); *B65D 81/34* (2013.01); *B65D 85/36* (2013.01); *B31B 2100/00* (2017.08); *B31B 2100/002* (2017.08); *B65D 2585/366* (2013.01)

(58) Field of Classification Search
CPC ... B65D 5/20; B65D 5/66; B65D 5/42; B65D 49/02; B65D 85/36
USPC ..... 229/110, 902, 906; 493/162
See application file for complete search history.

(56) References Cited

U.S. PATENT DOCUMENTS 2,973,858 A 3/1961 Laneve
3,462,065 A 8/1969 Norman
(Continued)

*Primary Examiner* — Christopher Demeree
(74) *Attorney, Agent, or Firm* — WestRock IP Legal

(57) ABSTRACT

A blank of foldable sheet material for forming a container is provided. The blank includes a top panel, a front tuck flap extending from a front edge of the top panel, and a top side panel extending from a side edge of the top panel. The blank also includes a bottom panel, a front panel extending from a front edge of the bottom panel, and a corner portion. The corner portion includes a minor diagonal panel extending and a major diagonal panel. The corner portion also includes a corner panel hingedly connected to the minor and major diagonal panels. The front panel is configured to engage the front tuck flap to at least partially define a first releasably secure closure of the container, and the top side panel includes a front edge configured to engage the minor diagonal panel to at least partially define a second releasably secure closure of the container.

20 Claims, 10 Drawing Sheets

Related U.S. Application Data continuation-in-part of application No. 29/491,522, filed on May 21, 2014, now abandoned.

(60) Provisional application No. 62/001,568, filed on May 21, 2014.

(51) Int. Cl.

| | |
|---|---|
| ***B65D 85/36*** | (2006.01) |
| ***B65D 5/20*** | (2006.01) |
| ***B65D 81/34*** | (2006.01) |
| *B31B 100/00* | (2017.01) |

(56) References Cited

U.S. PATENT DOCUMENTS

| | | | | |
|---|---|---|---|---|
| 3,512,697 | A | | 5/1970 | Robinson |
| 3,923,234 | A | | 12/1975 | Lund |
| 4,476,989 | A | | 10/1984 | Larsen |
| 4,747,485 | A | | 5/1988 | Chaussadas |
| 4,765,534 | A | | 8/1988 | Zion et al. |
| 4,809,908 | A | | 3/1989 | Keefe et al. |
| 4,919,326 | A | | 4/1990 | Deiger |
| 4,984,734 | A | | 1/1991 | Zion et al. |
| 4,993,625 | A | | 2/1991 | Stease et al. |
| 5,000,374 | A | | 3/1991 | Deiger |
| 5,056,710 | A | | 10/1991 | Ritter |
| 5,071,062 | A | | 12/1991 | Bradley et al. |
| 5,110,039 | A | | 5/1992 | Philips |
| 5,125,566 | A | | 6/1992 | Deiger |
| 5,211,329 | A | | 5/1993 | Patton |
| 5,263,634 | A | | 11/1993 | Korine |
| 5,358,173 | A | | 10/1994 | Mertz |
| 5,368,225 | A | | 11/1994 | Ritter |
| 5,381,949 | A | | 1/1995 | Correll |
| 5,402,929 | A | | 4/1995 | Ritter et al. |
| 5,452,845 | A | | 9/1995 | Ritter |
| 5,476,216 | A | | 12/1995 | Robertella et al. |
| 5,535,940 | A | | 7/1996 | Olds |
| 5,553,771 | A | | 9/1996 | Correll |
| 5,560,539 | A | | 10/1996 | Baxter |
| 5,586,716 | A | | 12/1996 | Correll |
| 5,595,339 | A | | 1/1997 | Correll |
| 5,702,054 | A | * | 12/1997 | Philips ..... B65D 5/6664 229/110 |
| 5,713,509 | A | | 2/1998 | Correll |
| 5,752,651 | A | | 5/1998 | Correll |
| 5,799,864 | A | | 9/1998 | Mertz |
| 5,806,755 | A | | 9/1998 | Correll |
| 5,833,130 | A | | 11/1998 | Correll |
| 5,881,948 | A | | 3/1999 | Correll |
| 5,918,797 | A | | 7/1999 | Correll |
| 5,961,035 | A | | 10/1999 | Correll |
| 6,016,951 | A | | 1/2000 | Correll |
| 6,065,669 | A | | 5/2000 | Correll |
| 6,092,715 | A | | 7/2000 | Correll |
| 6,109,512 | A | | 8/2000 | Morrison |
| 6,196,448 | B1 | | 3/2001 | Correll |
| 6,206,277 | B1 | | 3/2001 | Correll |
| 6,223,978 | B1 | | 5/2001 | Drager |
| 6,290,122 | B1 | | 9/2001 | Correll |
| 6,547,125 | B2 | | 4/2003 | Correll |
| 6,568,586 | B1 | | 5/2003 | Vanesley et al. |
| 6,685,085 | B2 | | 2/2004 | Hanna |
| 6,748,722 | B2 | | 6/2004 | Correll |
| 6,749,106 | B2 | | 6/2004 | Keefe et al. |
| 6,922,976 | B2 | | 8/2005 | Correll |
| 8,025,207 | B1 | | 9/2011 | Correll |
| D649,040 | S | | 11/2011 | Sanders |
| 8,627,998 | B2 | * | 1/2014 | Martinez ..... B65D 5/002 229/110 |
| 8,690,043 | B2 | | 4/2014 | Holch et al. |
| 2001/0000561 | A1 | | 5/2001 | Correll |
| 2003/0015578 | A1 | * | 1/2003 | Keefe, Jr. ..... B65D 5/2033 229/110 |
| 2003/0047593 | A1 | * | 3/2003 | Correll ..... B65D 5/2033 229/110 |
| 2003/0121961 | A1 | | 7/2003 | Pilgrim et al. |
| 2004/0222276 | A1 | | 11/2004 | Correll |
| 2004/0222277 | A1 | | 11/2004 | Correll |
| 2004/0222278 | A1 | | 11/2004 | Correll |
| 2005/0011939 | A1 | | 1/2005 | Angelopoulos et al. |
| 2005/0103832 | A1 | | 5/2005 | Correll |
| 2006/0208046 | A1 | | 9/2006 | Dennen et al. |
| 2007/0199981 | A1 | | 8/2007 | Oliveira |
| 2010/0108750 | A1 | | 5/2010 | Coleman |
| 2011/0253772 | A1 | | 10/2011 | Holch et al. |

* cited by examiner

BLANK AND METHODS OF CONSTRUCTING A CONTAINER FROM THE BLANK

CROSS-REFERENCE TO RELATED APPLICATIONS

This application is a continuation of U.S. patent application Ser. No. 14/717,541, filed May 20, 2015, entitled "Blank and Methods of Constructing a Container from the Blank," which is a continuation-in-part of U.S. patent application Ser. No. 29/491,522, filed May 21, 2014, entitled "Food Container," and claims the benefit of U.S. Provisional Application No. 62/001,568, filed May 21, 2014, entitled " Blank and Methods of Constructing a Container from the Blank," the disclosures of which are hereby incorporated herein by reference in their entirety.

BACKGROUND

The field of the disclosure relates generally to a container formed from a sheet of material, and more particularly to a container that includes side locking features and a front tuck flap.

It is well known in the food industry, including the pizza industry, to provide a food product to a consumer that is packaged in film, foil, paperwrap, a box, or a container. Such containers provide a convenient package to carry the food product from the producer of the food product to a table or other location for consumption by the consumer of the food product. It is also convenient to place multiple containers in a bag, such as an insulated bag, so a customer and/or delivery person is able to carry those containers from the restaurant for consumption elsewhere. At least some of these containers may be time-consuming to form. Moreover, at least some such known containers do not include easily formed features that facilitate securing a lid to a base of the container when the container is closed.

BRIEF DESCRIPTION

In one aspect, a blank of foldable sheet material for forming a container is provided. The blank includes a top portion including a top panel, a front tuck flap extending from a front edge of the top panel, and a first top side panel extending from a first side edge of the top panel. The blank also includes a bottom portion including a bottom panel, a first bottom side panel extending from a first side edge of the bottom panel, a front panel extending from a front edge of the bottom panel, and a corner portion. The corner portion includes a first minor diagonal panel extending from a front edge of the first bottom side panel and a first major diagonal panel extending from a first side edge of the front panel. The first major diagonal panel has a length greater than a length of the first minor diagonal panel. The corner portion also includes a first corner panel hingedly connected to the first minor and major diagonal panels. The front panel is configured to engage the front tuck flap to at least partially define a first releasably secure closure of the container in a closed position, and the first top side panel includes a front edge configured to engage the first minor diagonal panel to at least partially define a second releasably secure closure of the container in the closed position.

In another aspect, a container formed from a blank of foldable sheet material is provided. The container includes a top portion including a top panel hingedly connected to a front tuck flap along a front edge of the top panel and to a first top side panel along a first side edge of the top panel. The container also includes a bottom portion including a bottom panel, a first bottom side panel hingedly connected to a first side edge of the bottom panel, a front panel hingedly connected to a front edge of the bottom panel, and a corner portion. The corner portion includes a first minor diagonal panel extending from a front edge of the first bottom side panel and a first major diagonal panel extending from a first side edge of the front panel. The first major diagonal panel has a length greater than a length of the first minor diagonal panel. The corner portion also includes a first corner panel hingedly connected to the first minor and major diagonal panels. The first corner panel overlaps and is substantially parallel to the bottom panel. The front panel is engaged by the front tuck flap to at least partially define a first releasably secure closure of the container, and a front edge of the first top side panel is engaged by the first minor diagonal panel to at least partially define a second releasably secure closure of the container.

In another aspect, a method of constructing a container from a blank of sheet material is provided. The method includes rotating a first corner panel of the blank about a respective fold line toward an interior surface of the first blank to form a base. The blank includes a bottom panel, a first bottom side panel hingedly connected to a first side edge of the bottom panel, a front panel hingedly connected to a front edge of the bottom panel, and a corner portion. The corner portion includes a first minor diagonal panel extending from a front edge of the first bottom side panel and a first major diagonal panel extending from a first side edge of the front panel, the first major diagonal panel having a length greater than a length of said first minor diagonal panel. The corner portion also includes a first corner panel hingedly connected to the first minor and major diagonal panels. The rotating causes further rotation of the first major diagonal panel, the first minor diagonal panel, the front panel, and the first bottom side panel about respective fold lines toward the interior of the blank, such that, after the rotating, the corner panel is overlapping and substantially parallel to the bottom panel of the blank, and the first major diagonal panel, the first minor diagonal panel, the front panel, and the first bottom side panel are substantially perpendicular to the bottom panel. The method also includes rotating a first top side panel of the blank about a respective fold line toward the interior surface of the blank to form a lid. The blank further includes a top panel hingedly connected to a front tuck flap along a front edge of the top panel and to the first top side panel along a first side edge of the top panel. The method further includes rotating the lid toward the base such that the front panel is engaged by the front tuck flap to at least partially define a first releasably secure closure of the container, and a front edge of the first top side panel is engaged by the first minor diagonal panel to at least partially define a second releasably secure closure of the container.

DETAILED DESCRIPTION

Figure 1:
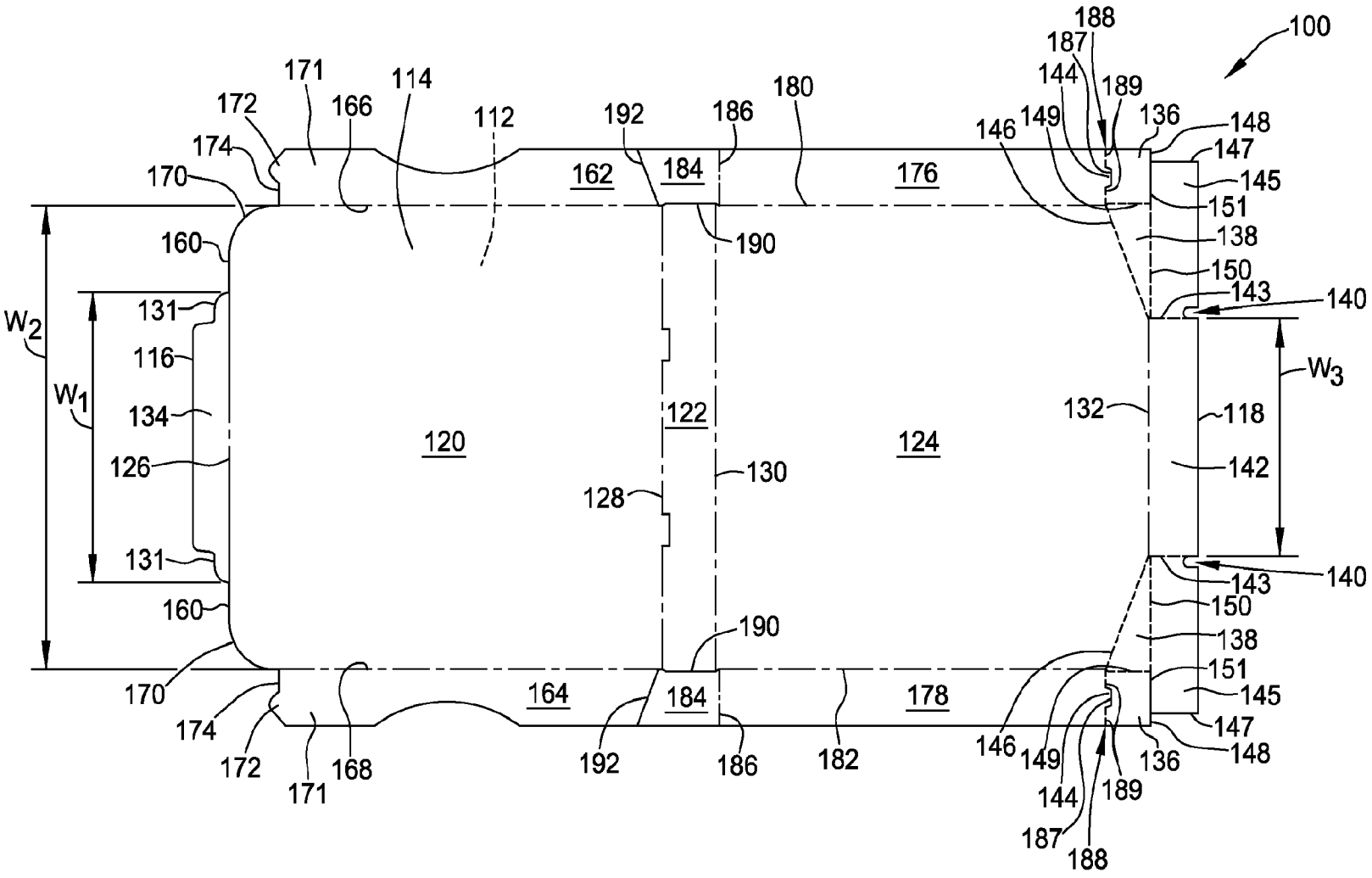
FIG. 1 is a top plan view of a blank of sheet material for constructing a container according to a first embodiment of the present invention.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present disclosure provides a stackable, collapsible container. In some embodiments, the container includes a first releasably secure closure of a lid and a base, defined by engagement of a front tuck flap on the lid and a front panel of the base, and the container also includes a second releasably secure closure of the lid and the base, defined by engagement of front edges of the side panels of the lid and minor diagonal panels of the base. The container is constructed from a blank of sheet material. The blank is formed by a machine that imparts fold lines, cut lines, and other lines of weakness to the blank. In one embodiment, the container is fabricated from a paperboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

Unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

In an example embodiment, the container includes at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product, and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Figure 2:
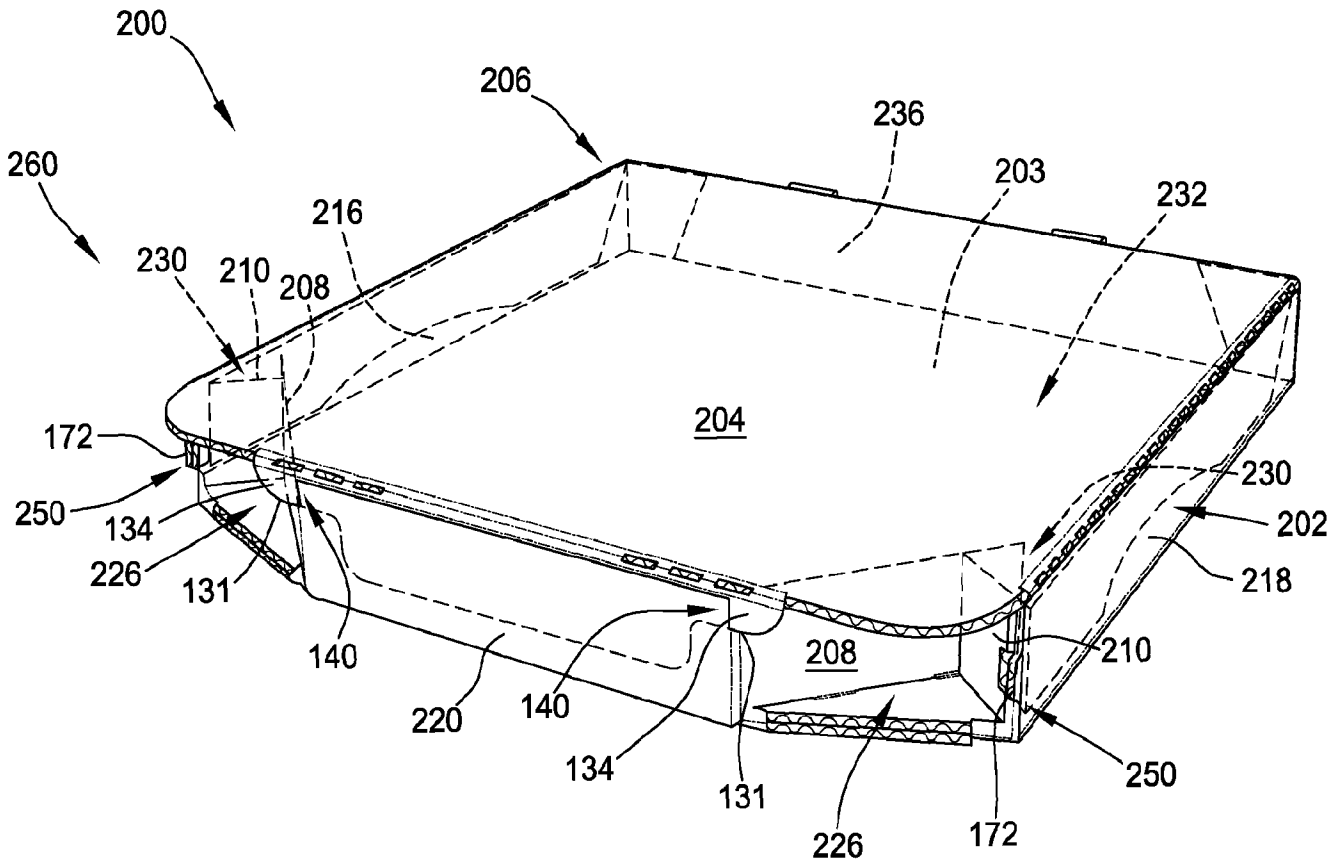
FIG. 2 is a perspective view of a container formed from the blank shown in FIG. 1.

Referring now to the drawings, and more specifically to FIGS. 1 and 2, although as described above a container may have any suitable size, shape, and/or configuration, FIGS. 1 and 2 illustrate the construction or formation of a first embodiment of a container. Specifically, FIG. 1 is a top plan view of a first example embodiment of a blank 100 of sheet material. FIG. 2 is a perspective view of a first example embodiment of a container 200 formed from blank 100 shown in FIG. 1.

Referring to FIG. 1, blank 100 has a first or interior surface 112 and an opposing second or exterior surface 114. Further, blank 100 defines a leading edge 116 and a trailing edge 118. Blank 100 includes, from leading edge 116 to trailing edge 118, a front tuck flap 134, a top panel 120, a back panel 122, a bottom panel 124, and a front panel 142, coupled together along preformed, generally parallel, fold lines 126, 128, 130, and 132, respectively. Fold lines and/or hinge lines as described herein may include any suitable line of weakening and/or line of separation known to those skilled in the art and guided by the teachings herein provided.

More specifically, top panel 120 extends from front tuck flap 134 along fold line 126, back panel 122 extends from top panel 120 along fold line 128, bottom panel 124 extends from back panel 122 along fold line 130, and front panel 142 extends from bottom panel 124 along fold line 132. In the example embodiment, front tuck flap 134 includes a pair of offset edges 131 disposed at opposite ends of front tuck flap 134. More specifically, offset edges 131 are offset from leading edge 116 of blank 100. In alternative embodiments, front tuck flap 134 does not include offset edges 131.

In the example embodiment, front tuck flap 134 has a width W.sub.1 that is less than a width W.sub.2 of top panel 120, such that a pair of free edges 160 of top panel 120 are defined on opposing sides of, and substantially co-linear with, fold line 126. Free edges 160 and fold line 126 cooperate to form a front edge of top panel 120, and fold line 128 defines a back edge of top panel 120. In alternative embodiments, width W.sub.1 is equal to or greater than width W.sub.2, such that top panel 120 does not include free edges 160.

Top panel 120 includes a first top side panel 162 and a second top side panel 164 extending therefrom along respective opposing fold lines 166 and 168. More specifically, first top side panel 162 extends from top panel 120 along fold line 166, and second top side panel 164 extends from top panel 120 along fold line 168. Fold lines 166 and 168 define side edges of top panel 120. Each of first top side panel 162 and second top side panel 164 includes a front edge 174 that is configured to engage one of minor diagonal panels 136 to at least partially define the second releasably secure closure of container 200 in a closed position 260. For example, in the illustrated embodiment, each of first top side panel 162 and second top side panel 164 includes a front portion 171 proximate front edge 174, and a locking tab 172 that extends from front edge 174. More specifically, in the example embodiment, each locking tab 172 is configured to be received in a locking aperture 250 defined in a minor diagonal wall 210 of container 200 to at least partially define the second releasably secure closure of container 200 in closed position 260, as shown in FIG. 2.

In the example embodiment, top panel 120 includes a pair of rounded front corner edges 170. Each rounded front corner edge 170 extends between a free edge 160 and a respective side edge of top panel 120. Alternatively, top panel 120 does not include rounded front corner edges 170.

Bottom panel 124 has a first bottom side panel 176 and a second bottom side panel 178 extending therefrom along respective opposing fold lines 180 and 182. More specifically, first bottom side panel 176 extends from bottom panel 124 along fold line 180, and second bottom side panel 178 extends from bottom panel 124 along fold line 182. Fold lines 180 and 182 define side edges of bottom panel 124. Furthermore, each bottom side panel 176 and 178 includes a back tab 184 extending from a respective back edge 186 of the bottom side panel 176 or 178. Each back edge 186 is defined by a fold line. Each back tab 184 is separated from back panel 122 by a cut line 190, and further separated from an adjacent one of top side panels 162 and 164 by a cut line 192. In an alternative embodiment (not shown), each back tab 184 extends from one of top side panels 162 and 164 such that a fold line couples back tab 184 to top side panel 162 or 164, and a cut line separates each back tab 184 from bottom side panel 176 or 178.

In the example embodiment, each bottom side panel 176 and 178 also has a minor diagonal panel 136 extending from a respective front edge 188 of the bottom side panel. Each bottom side panel front edge 188 is partially defined by a cut line 187 that defines a slot-forming tab 144 on bottom side panel front edge 188, and further at least partially defined by at least one fold line 189 extending from an end of cut line 187. In the example embodiment, the at least one fold line 189 is a pair of fold lines 189 that extend from opposing edges of cut line 187. Each slot forming tab 144 is configured to form one of locking apertures 250 of container 200, as shown in FIG. 2, when minor diagonal panel 136 is rotated about fold line 189.

Front panel 142 includes a pair of oppositely disposed side edges 143. Each side edge 143 is defined by a fold line. A major diagonal panel 145 extends from each side edge 143. Each major diagonal panel 145 has a length greater than a length of each minor diagonal panel 136, wherein the length of major diagonal panel 145 is measured between a respective fold line 143 and a respective side edge 147 of major diagonal panel 145, and the length of minor diagonal panel 136 is measured between a respective fold line 188 and a front edge 148 of minor diagonal panel 136.

Fold line 132 defines a front edge of bottom panel 124, and fold line 130 defines a back edge of bottom panel 124. In addition, bottom panel 124 includes a pair of oppositely disposed angled edges 146 that extend from opposing ends of fold line 132 to bottom panel side edges 180 and 182, respectively. Each angled edge 146 is defined by a respective fold line. A corner panel 138 extends from each angled edge 146. Moreover, each corner panel 138 is separated from an adjacent minor diagonal panel 136 by a fold line 149, and is separated from an adjacent major diagonal panel 145 by a respective fold line 150. In addition, each minor diagonal panel 136 is separated from an adjacent major diagonal panel 145 by a respective cut line 151.

Front panel 142 is configured to engage front tuck flap 134 to at least partially define a first releasably secure closure of container 200 in closed position 260. For example, in the illustrated embodiment, a notch 140 is defined in trailing edge 118 along each side edge 143 of front panel 142. Each notch 140 is configured to receive at least a portion of front tuck flap 134 to at least partially define the first releasably secure closure of container 200 in closed position 260, as shown in FIG. 2. In alternative embodiments, any suitable number of notches 140 disposed at any suitable location are configured to receive any suitable portion of front tuck flap 134. In the example embodiment, front panel 142 has a width W.sub.3 that is less than or equal to width W.sub.1 of front tuck flap 134. In alternative embodiments, width W.sub.3 is greater than width W.sub.1.

With reference to FIGS. 1 and 2, to construct container 200 from blank 100, a base 202 of container 200 and a lid 206 of container 200 are formed. To form base 202, corner panels 138 are rotated about respective fold lines 146 toward interior surface 112 to overlap at least a portion of bottom panel 124. After rotation, corner panels 138 are substantially parallel to bottom panel 124 such that interior surface 112 of each corner panel 138 is adjacent to interior surface 112 of bottom panel 124. Bottom panel 124 and corner panels 138 form a bottom wall 203 of container 200.

When corner panels 138 are rotated toward interior surface 112, major diagonal panels 145, minor diagonal panels 136, and front panel 142 are also rotated about respective fold lines 146, 143, 150, 149, and 132 toward interior surface 112 because of the interconnectivity of each of major diagonal panels 145, minor diagonal panels 136, and front panel 142 with corner panels 138. In addition, bottom side panels 176 and 178 are also rotated about respective fold lines 180 and 182 toward interior surface 112 because of the interconnectivity of bottom side panels 176 and 178 with respective minor diagonal panels 136. As such, major diagonal panels 145, minor diagonal panels 136, bottom side panels 176 and 178, and front panel 142 are rotated into position concurrently with corner panels 138 in one motion. Major diagonal panels 145 form respective major diagonal walls 208, and minor diagonal panels 136 form respective minor diagonal walls 210. Bottom side panels 176 and 178 are configured to form a portion of respective first and second side walls 216 and 218, and front panel 142 is configured to form a portion of a front wall 220. After rotation, bottom side panels 176 and 178, front panel 142, major diagonal walls 208, and minor diagonal walls 210 are substantially perpendicular to bottom wall 203.

In the example embodiment, when minor diagonal panels 136 are rotated, slot-forming tabs 144 separate from minor diagonal panels 136, forming locking apertures 250 in each minor diagonal wall 210 adjacent first and second side walls 216 and 218. Further, when corner panels 138 are rotated into position, front edges 148 of each minor diagonal panel 136 contact an adjacent major diagonal panel 145, and side edges 147 of each major diagonal panel 145 are adjacent to, but spaced from, a respective adjacent bottom side panel 176 and 178. Each minor diagonal wall 210 extends from front edge 188 of the respective bottom side panel 176 and 178 at an acute angle relative to the bottom side panel, and each major diagonal wall 208 extends from one of side edges 143 of front panel 142 at an obtuse angle relative to front panel 142. A recess 226 is defined by each major diagonal wall 208, minor diagonal wall 210, and corner panel 138. Further, each of bottom side panels 176 and 178 cooperates with an adjacent minor diagonal wall 210 and an adjacent major diagonal wall 208 to define a respective chamber 230 within a cavity 232 of base 202. Each chamber 230 is separated from one of recesses 226 by a corresponding minor diagonal wall 210.

Back tabs 184 are rotated about respective fold lines 186 toward interior surface 112 to form a portion of a back wall 236 that at least partially defines cavity 232. It should be understood that back tabs 184 may be rotated into position before or after corner panels 138 are rotated toward interior surface 112.

To construct lid 206 of container 200, top side panels 162 and 164 are rotated about respective fold lines 166 and 168 toward interior surface 112, and front tuck flap 134 is rotated about fold line 126 toward interior surface 112, such that top side panels 162 and 164 and front tuck flap 134 are perpendicular to top panel 120. It should be understood that lid 206 may be formed before base 202 is formed.

To close container 200, lid 206 is rotated toward base 202 along fold lines 128 and 130. As lid 206 is rotated toward base 202, back panel 122 is rotated about fold line 130 to form back wall 236. More specifically, back wall 236 is formed when back panel 122 is adjacent to back tabs 184. Additionally, when container 200 is closed, top panel 120 forms a top wall 204 of container 200, and front tuck flap 134 engages front panel 142 to form front wall 220 of container 200 and at least partially define the first releasably secure closure of lid 206 and base 202. In the example embodiment, each notch 140 receives at least a portion of front tuck flap 134 to at least partially define the first releasably secure closure of lid 206 and base 202. More specifically, each notch 140 receives one of pair of offset edges 131 of front tuck flap 134 to at least partially define the first releasably secure closure of lid 206 and base 202. In alternative embodiment, each notch 140 receives any suitable portion of front tuck flap 134.

In addition, when container 200 is closed, top side panel 162 cooperates with bottom side panel 176 to form first side wall 216 of container 200, and top side panel 164 cooperates with bottom side panel 178 to form second side wall 218 of container 200. More specifically, exterior surface 114 of each top side panel 162 and 164 contacts interior surface 112 of respective bottom side panel 176 and 178, and front portion 171 of each top side panel 162 and 164 is at least partially disposed within one of chambers 230. Moreover, each front edge 174 of top side panels 162 and 164 engages one of minor diagonal panels 136 to at least partially define the second releasably secure closure of container 200 in closed position 260. For example, in the illustrated embodiment, locking tab 172 of each front edge 174 is received in a respective locking aperture 250 of minor diagonal walls 210, at least partially defining the second releasably secure closure of lid 206 and base 202.

Additionally, front portion 171 of top side panel 162 is received between bottom side panel 176 and side edge 147 of adjacent major diagonal panel 145, and front portion 171 of top side panel 164 is received between bottom side panel 178 and side edge 147 of adjacent major diagonal panel 145. In certain embodiments, each front portion 171 is so received in a friction fit, defining a third releasably secure closure of lid 206 and base 202. In alternative embodiments, each front portion 171 is so received in a clearance fit and/or a non-contact fit.

Prior to closing container 200, a product, such as a food product, may be placed within base 202. As such, when lid 206 engages base 202, the product is secured within cavity 232 by lid 206 and base 202.

As such, the following steps are performed to form container 200 from blank 100: (1) rotate corner panels 136 toward bottom panel 124 to form base 202; (2) rotate back tabs 184 toward interior surface 112 to form a portion of back wall 236; (3) rotate front tuck flap 134 and top side panels 162 and 164 toward interior surface 12 to form lid 206; and (4) rotate lid 206 toward base 202 to form side walls 216 and 218 and front wall 220. In an alternative embodiment, steps (1) and (2) are interchanged. In another alternative embodiment, step (3) is performed before steps (1) and (2).

Figure 3:
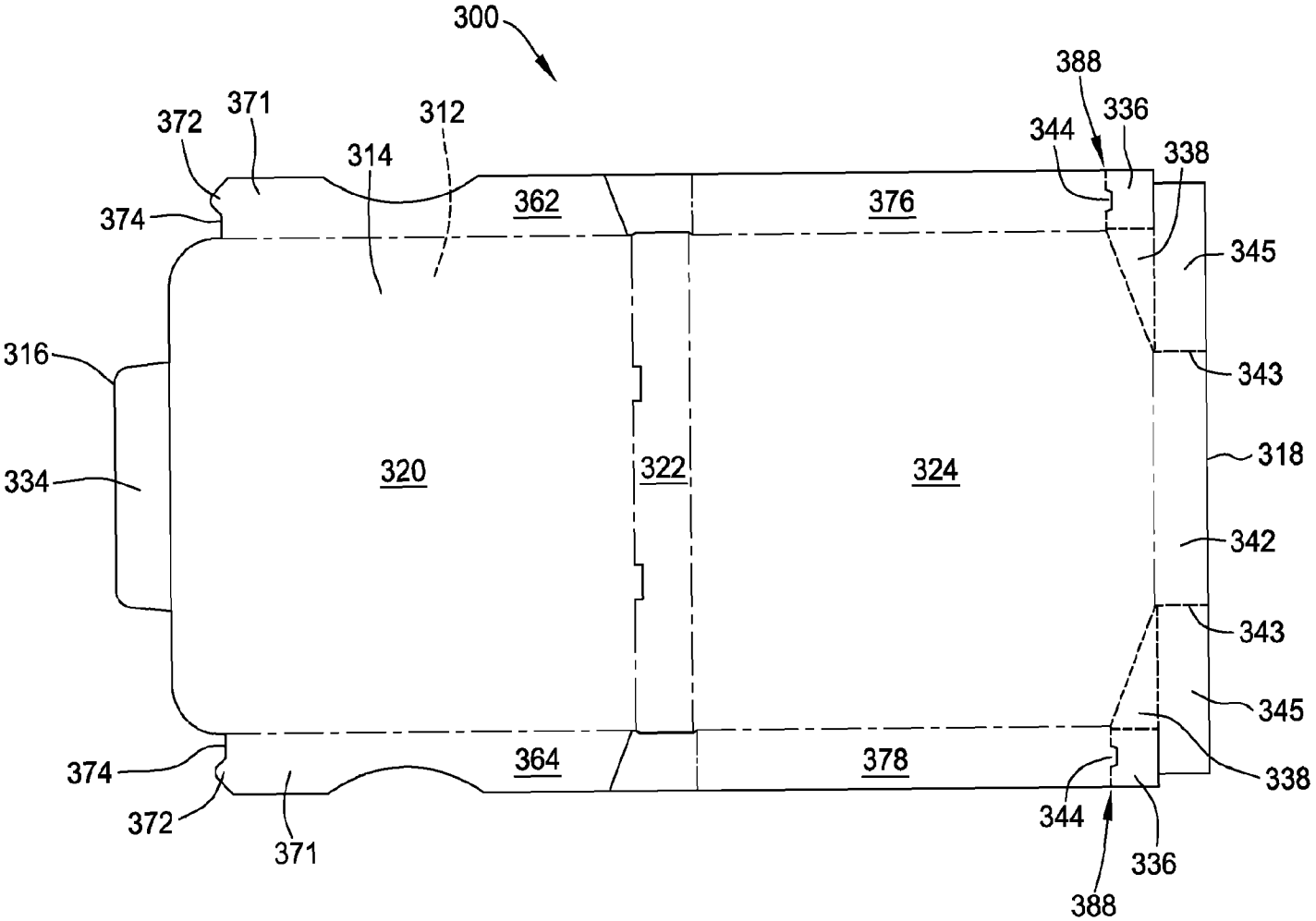
FIG. 3 is a top plan view of a blank of sheet material for constructing a container according to a second embodiment of the present invention.
Figure 4:
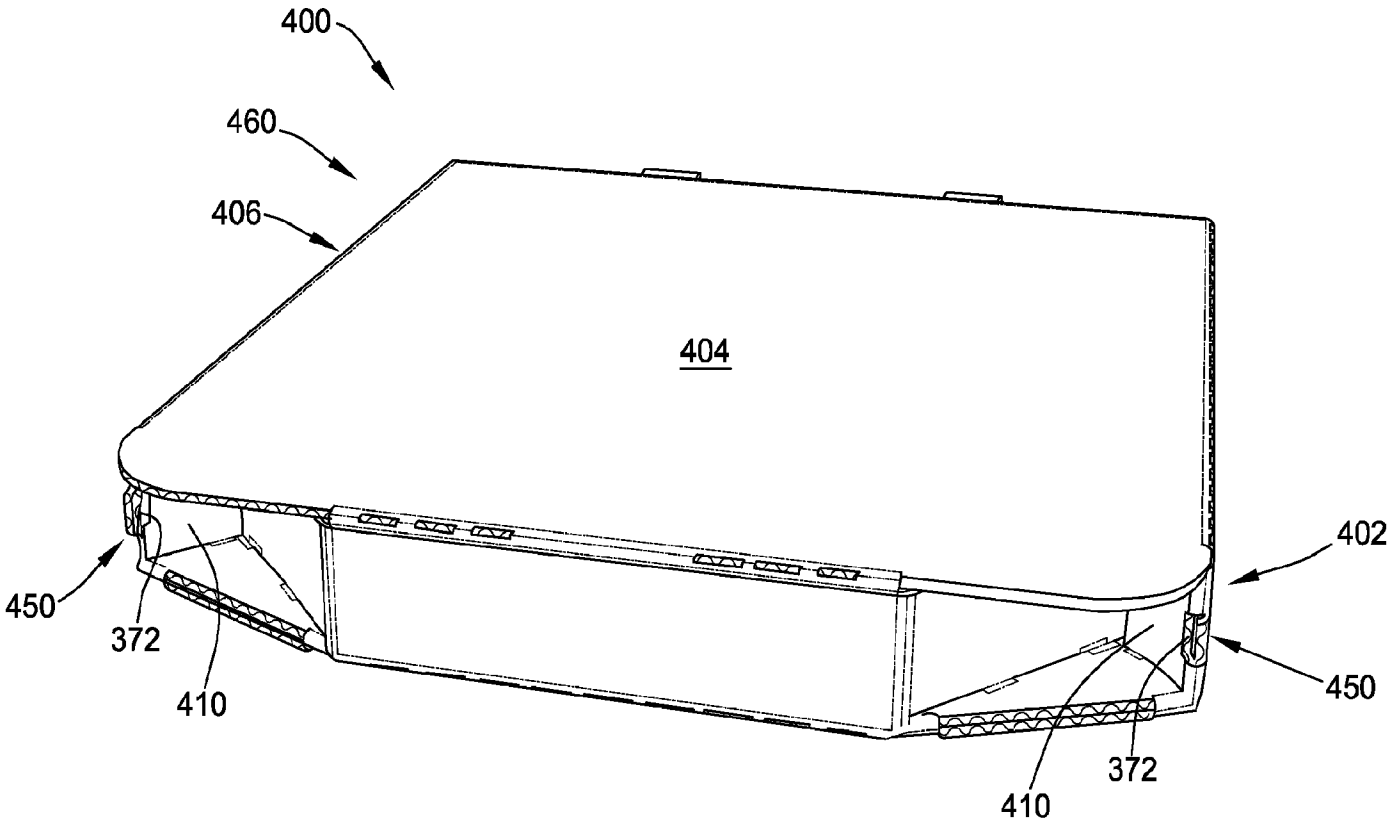
FIG. 4 is a perspective view of a container formed from the blank shown in FIG. 3.

FIG. 3 is a top plan view of a second example embodiment of a blank 300 of sheet material. Similar to blank 100, blank 300 includes, from a leading edge 316 to a trailing edge 318, a front tuck flap 334, a top panel 320, a back panel 322, a bottom panel 214, and a front panel 342. Blank 300 also includes corner panels 338 and major diagonal panels 345. FIG. 4 is a perspective view of a second example embodiment of a container 400 formed from blank 300 shown in FIG. 3. Blank 300 and container 400 are substantially similar to blank 100 and container 200 shown in FIGS. 1 and 2, except as otherwise noted. In particular, front tuck flap 334 does not include offset edges such as offset edges 131 of blank 100, and no notches such as notches 140 of blank 100 are defined along side edges 343 of front panel 342. Instead, the first releasably secure closure of lid 406 and base 402 is at least partially defined by a friction fit between exterior surface 314 of front tuck flap 334 and interior surface 312 of front panel 342.

Similar to blank 100, each of a first top side panel 362 and a second top side panel 364 of blank 300 includes a front portion 371 proximate a front edge 374, and a locking tab 372 that extends from front edge 374. A front edge 388 of each bottom side panel 376 and 378 includes a slot-forming tab 344 configured to form a locking aperture 450 in one of minor walls 410 of container 400 when a minor diagonal panel 336 is rotated to form container 400. Each locking tab 372 is received in one of locking apertures 450 to at least partially define the second releasably secure closure of container 400 in closed position 460.

Figure 5:
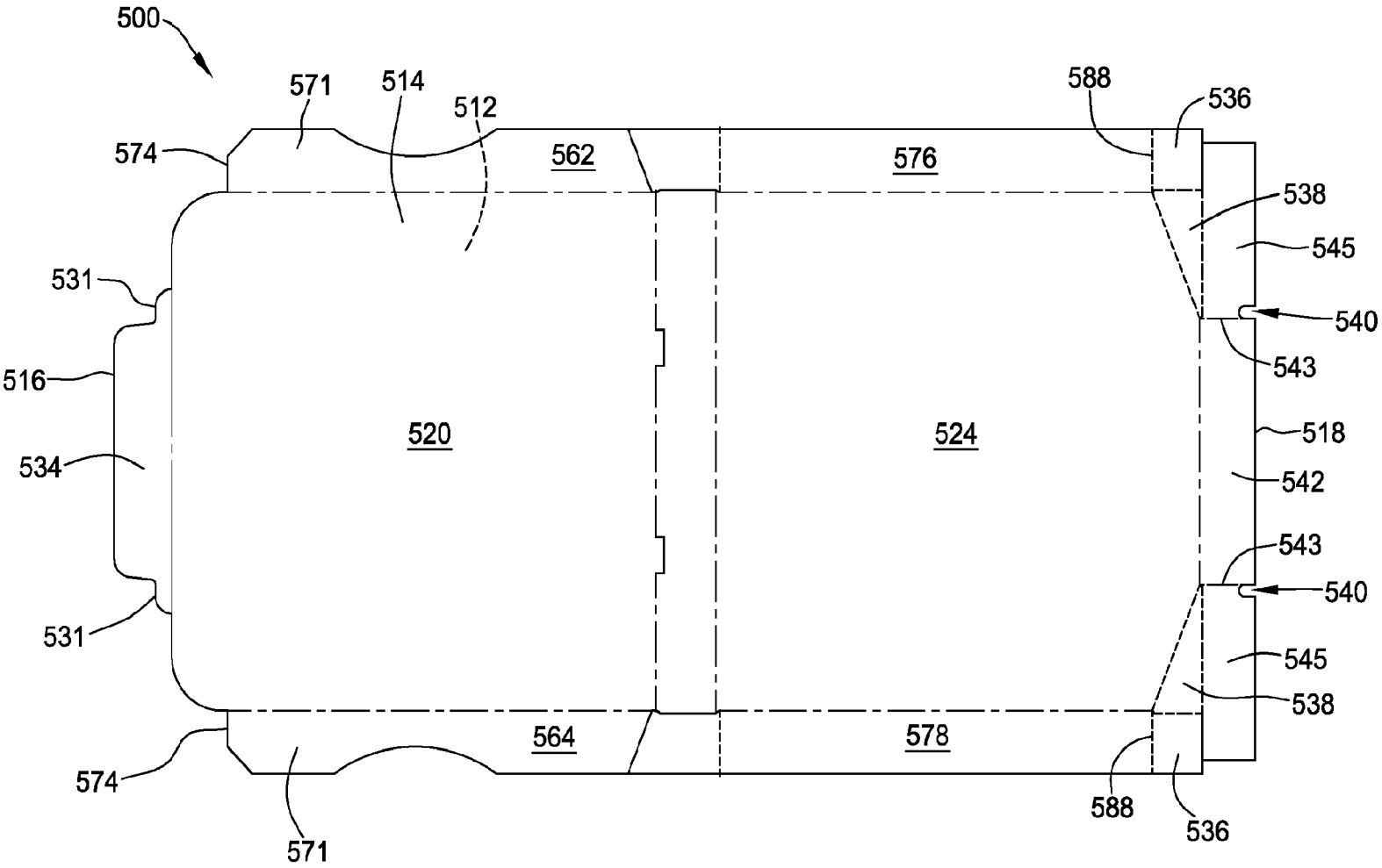
FIG. 5 is a top plan view of a blank of sheet material for constructing a container according to a third embodiment of the present invention.
Figure 6:
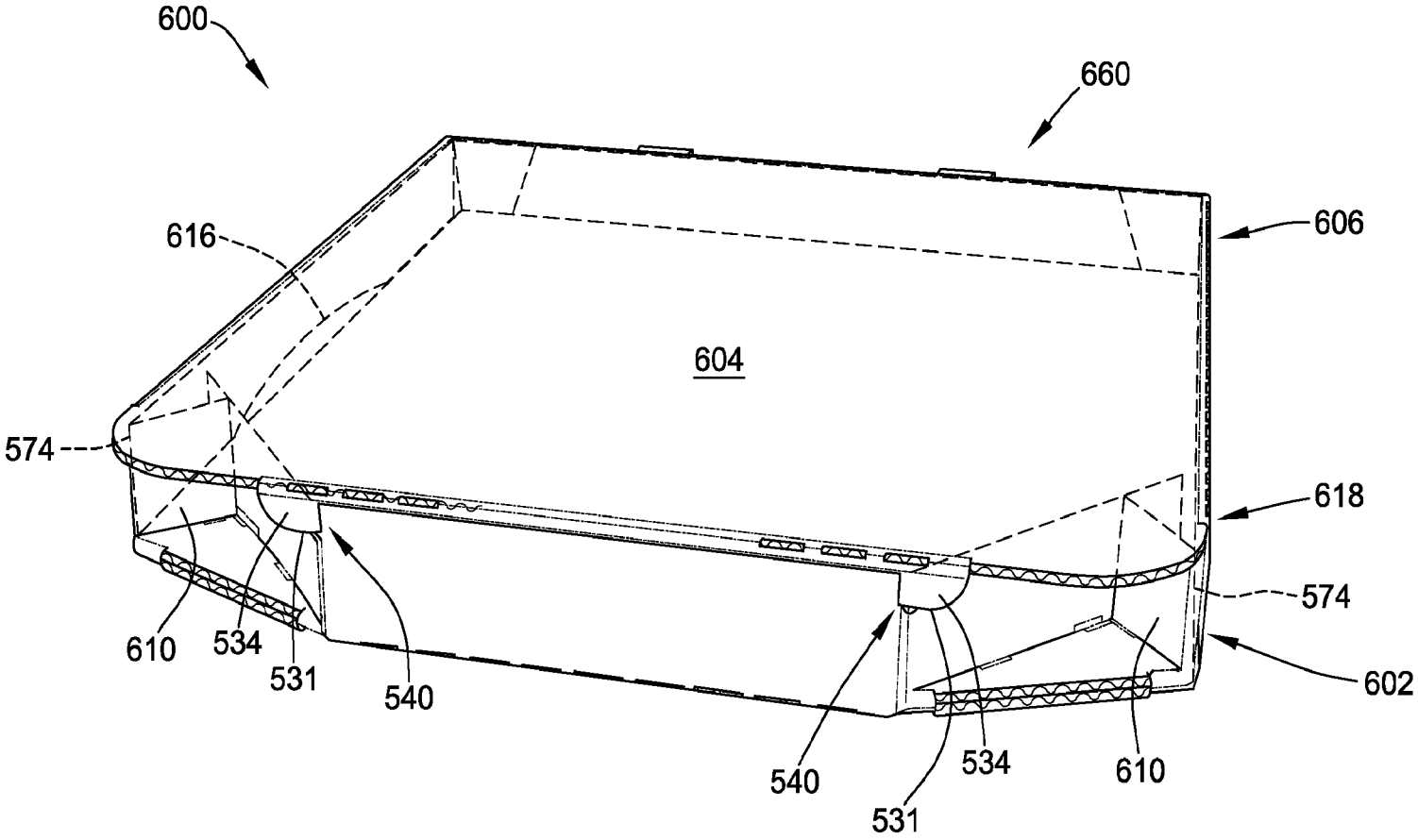
FIG. 6 is a perspective view of a container formed from the blank shown in FIG. 5.

FIG. 5 is a top plan view of a third example embodiment of a blank 500 of sheet material. Similar to blank 100, blank 500 includes an interior surface 512 and an interior surface 514, a top panel 520, a bottom panel 524, minor diagonal panels 536, corner panels 538, and major diagonal panels 545. FIG. 6 is a perspective view of a third example embodiment of a container 600 formed from blank 500 shown in FIG. 5. Similar to container 200, container 600 includes side walls 616 and 618. Blank 500 and container 600 are substantially similar to blank 100 and container 200 shown in FIGS. 1 and 2, except as otherwise noted. In particular, similar to blank 100, a front tuck flap 534 includes a pair of offset edges 531 disposed at opposite ends of front tuck flap 534. More specifically, offset edges 531 are offset from a leading edge 516 of blank 500. In alternative embodiments, front tuck flap 534 does not include offset edges 531. Also similarly, a notch 540 is defined in a trailing edge 518 of blank 500 along each side edge 543 of a front panel 542. Each notch 540 is configured to receive at least a portion of front tuck flap 534 to at least partially define the first releasably secure closure of container 600 in a closed position 660. For example, in the illustrated embodiment, each notch 540 receives one of pair of offset edges 531 of front tuck flap 534 to at least partially define the first releasably secure closure of lid 606 and base 602. In alternative embodiments, each notch 540 receives any suitable portion of front tuck flap 534.

Each of a first top side panel 562 and a second top side panel 564 of blank 500 includes a front portion 571 proximate a front edge 574. However, unlike blank 100, front edge 574 does not include a locking tab such as locking tab 172 (shown in FIG. 1), and a front edge 588 of bottom side panels 576 and 578 does not include a slot-forming tab such as slot-forming tab 144 (shown in FIG. 1). Instead, each front edge 574 is configured to engage interior surface 512 of one of minor diagonal walls 610 in a friction fit when container 600 is in a closed position 660, to at least partially define the second releasably secure closure of lid 606 and a base 602.

Figure 7:
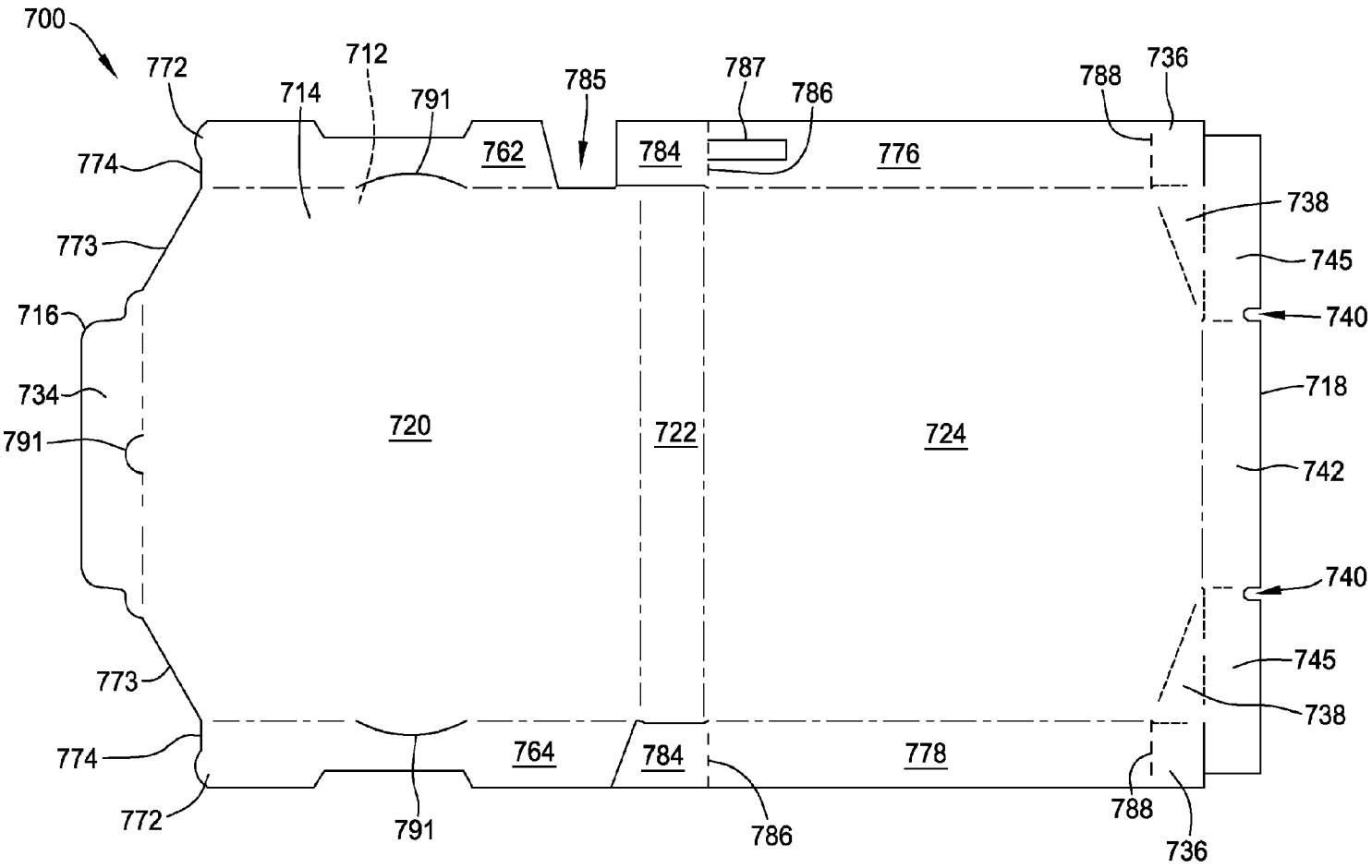
FIG. 7 is a top plan view of a blank of sheet material for constructing a container according to a fourth embodiment of the present invention.
Figure 8:
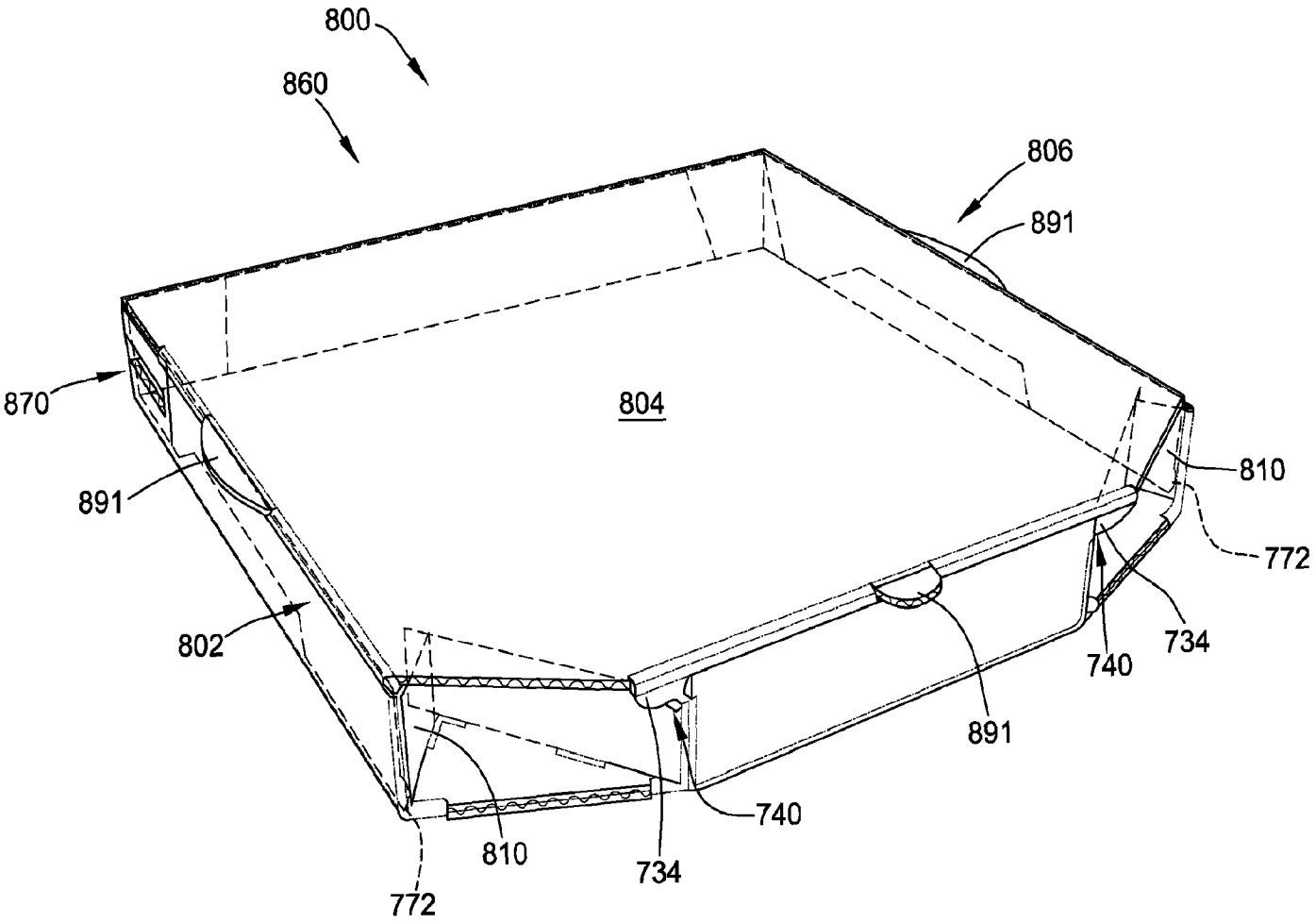
FIG. 8 is a perspective view of a container formed from the blank shown in FIG. 7.

FIG. 7 is a top plan view of a fourth example embodiment of a blank 700 of sheet material. Similar to blank 100, blank 700 includes, from a leading edge 716 to a trailing edge 718, a front closure flap 734, a bottom panel 720, a back panel 722, a bottom panel 724, and a front panel 742. Blank 700 also includes an interior surface 712 and an exterior surface 714, as well as minor diagonal panels 736, corner panel 738, major diagonal panels 745, and at least one notch 740 configured to receive at least a portion of front tuck flap 734. FIG. 8 is a perspective view of a fourth example embodiment of a container 800 formed from blank 700 shown in FIG. 7. Blank 700 and container 800 are substantially similar to blank 100 and container 200 shown in FIGS. 1 and 2, except as otherwise noted. Unlike blank 100, a front edge 788 of bottom side panels 776 and 778 does not include a slot-forming tab such as slot-forming tab 144 (shown in FIG. 1). However, a front edge 774 of top side panels 762 and 764 includes a locking tab 772 configured to engage interior surface 712 of one of minor diagonal walls 810 in a friction fit when container 800 is in a closed position 860, to at least partially define the second releasably secure closure of a lid 806 and a base 802.

In addition, in the illustrated embodiment, a gap 785 is defined in blank 700 between at least one of top side panels 762 and 764 and an adjacent back tab 784. In addition, a slot 787 is defined in a corresponding at least one of bottom side panels 776 and 778 and extends from a back edge 786 of the bottom side panel. Each gap 785 cooperates with the corresponding slot 787 to form a vent 870 in container 800. In alternative embodiments, blank 700 and container 800 do not include gap 785, slot 787, and vent 870.

Further in the illustrated embodiment, a top panel 720 includes a pair of diagonal front corner edges 773, rather than rounded front corner edges 170 (shown in FIG. 1). In alternative embodiments, top panel 720 includes any suitable front corner edge shape.

Also in the illustrated embodiment, top panel 720 includes extensions 791 defined by cut lines. Extensions 791 are configured to form lifting tabs 891 of lid 806 when container 800 is formed. In alternative embodiments, blank 700 and container 800 do not include extensions 791 and lifting tabs 891.

Figure 9:
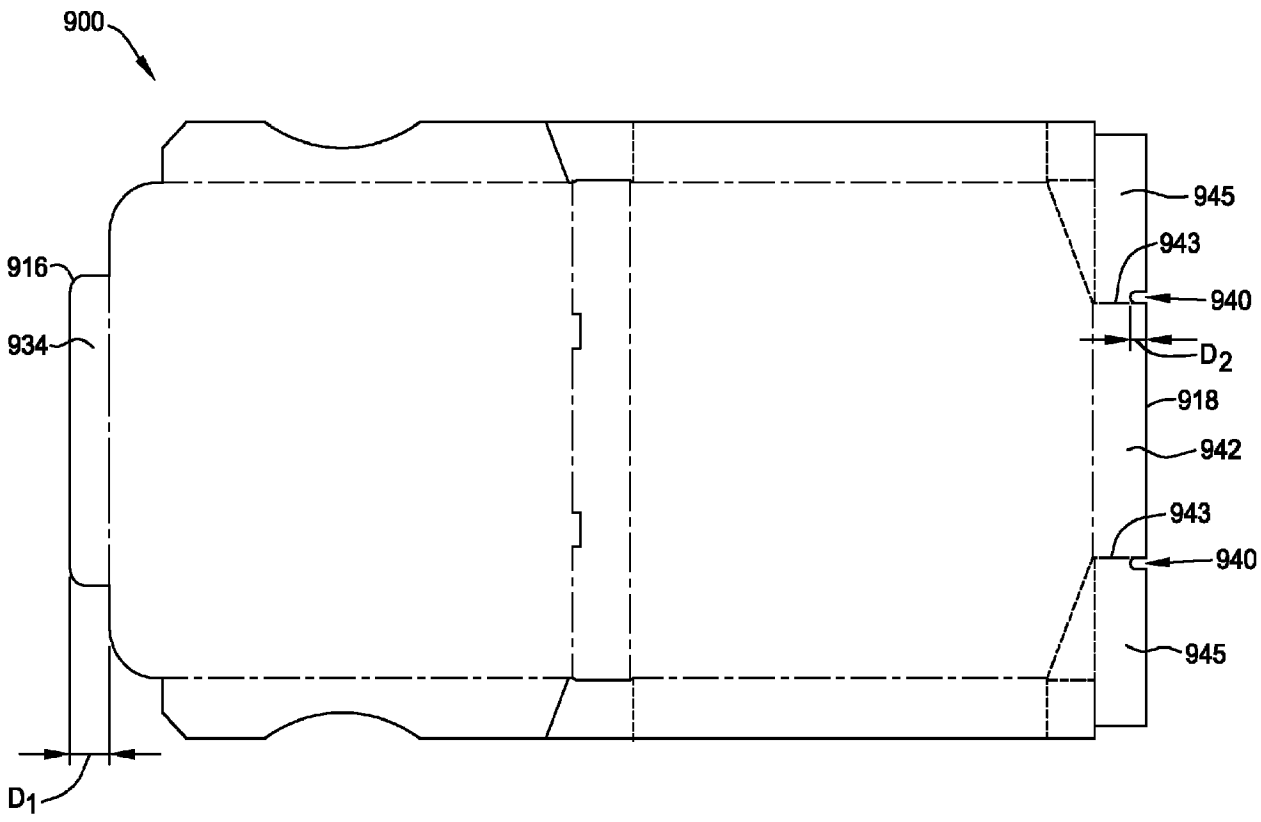
FIG. 9 is a top plan view of a blank of sheet material for constructing a container according to a fifth embodiment of the present invention.

FIG. 9 is a top plan view of a fifth example embodiment of a blank 900 of sheet material. Similar to blank 100, blank 900 includes a leading edge 918 and a trailing edge 918, as well as major diagonal panels 945. Blank 900 is substantially similar to blank 100 shown in FIG. 1, and is configured to form a container substantially similar to container 200 shown in FIG. 2, except as otherwise noted. In particular, similar to blank 100, a notch 940 is defined in a trailing edge 918 of blank 900 along each side edge 943 of a front panel 942. However, a front tuck flap 934 does not include offset edges such as offset edges 131 of blank 100. Instead, front tuck flap 934 has a substantially constant depth D.sub.1 along substantially an entire length of front tuck flap 934 that is sized to be received within notches 940. More specifically, each notch 940 has a depth D.sub.2 that is substantially equal to or greater than depth D.sub.1, such that each notch 940 is configured to receive at least a portion of front tuck flap 934 to at least partially define the first releasably secure closure of the container in a closed position.

Figure 10:
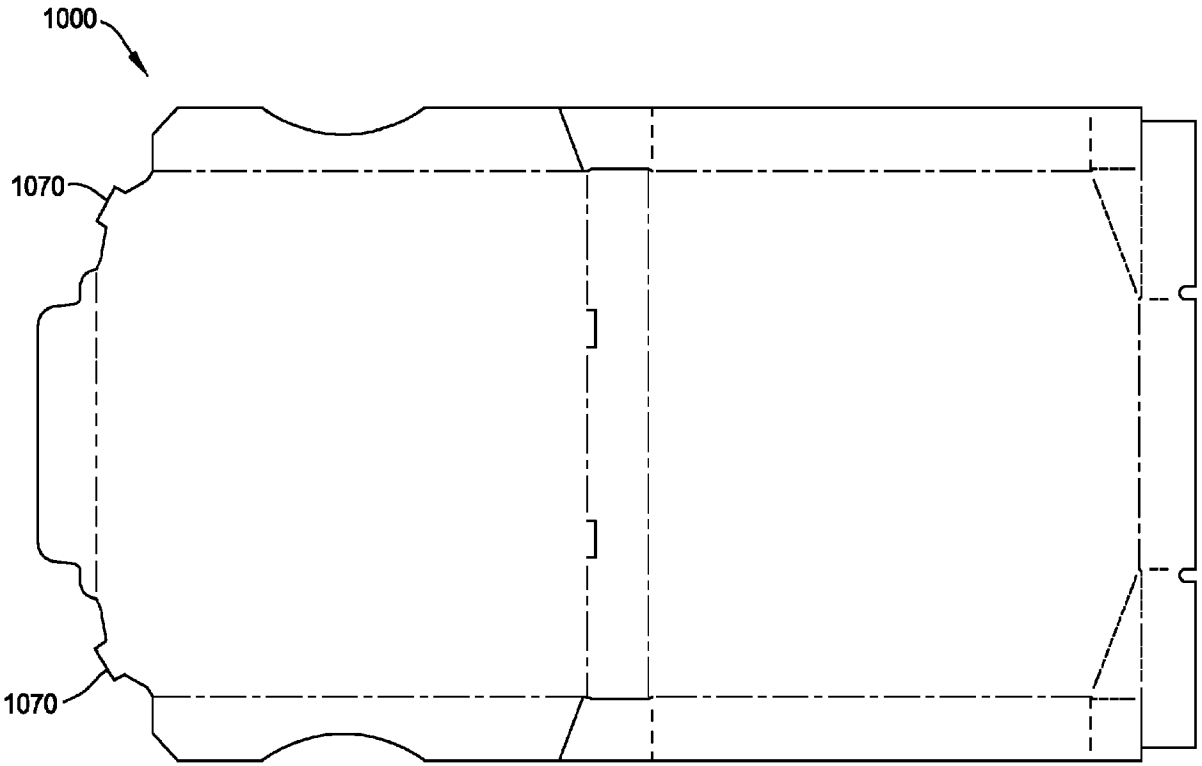
FIG. 10 is a top plan view of a blank of sheet material for constructing a container according to a sixth embodiment of the present invention.

FIG. 10 is a top plan view of a sixth example embodiment of a blank 1000 of sheet material. Blank 1000 is substantially similar to blank 100 shown in FIG. 1, and is configured to form a container substantially similar to container 200 shown in FIG. 2, except as otherwise noted. In particular, blank 1000 includes a pair of front corner edge projections 1070 that are configured to form lifting tabs for a lid of the container. In the illustrated embodiment, each projection 1070 is generally rectangular-shaped. In an alternative embodiment, each projection 1070 is generally semi-circular-shaped. In other alternative embodiments, each projection 1070 has any suitable shape that facilitates lifting the lid of the container formed from blank 1000.

Embodiments of the above-described container are easily constructed from a flexible unitary blank of paperboard. Further, embodiments of the above-described container include an easily formed first releasably secure closure of a lid and a base, at least partially defined by engagement of a front tuck flap on the lid and a front panel of the base, and an easily formed second releasably secure closure of the lid and the base, at least partially defined by engagement of front edges of the side panels of the lid and minor diagonal panels of the base.

Exemplary embodiments of a container have been described above in detail. The container is not limited to the specific embodiments described herein, but rather, components of the container and/or steps of the method may be utilized independently and separately from other components and/or steps described herein. Further, the described components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

The invention claimed is:

1. A blank of foldable sheet material for forming a container, said blank comprising:

a top portion comprising a top panel, and a first top side panel extending from a first side edge of said top panel, the first top side panel having a front edge including a portion extending therefrom; and a bottom portion comprising a bottom panel, a first bottom side panel extending from a first side edge of said bottom panel, a front panel extending from a front edge of said bottom panel, and a corner portion comprising:

a first minor diagonal panel extending from a front edge of said first bottom side panel;

a first major diagonal panel extending from a first side edge of said front panel, said first major diagonal panel having a length greater than a length of said first minor diagonal panel; and a first corner panel hingedly connected to said first minor and major diagonal panels, wherein said extending portion is configured to contact said first minor diagonal panel to at least partially define a first releasably secure closure of the container in the closed position.

2. The blank of claim 1, wherein said extending portion is in a friction fit with said first minor diagonal panel when the blank is erected into a carton.

3. The blank of claim 1, further comprising a front tuck flap extending from a front edge of said top panel, wherein said front panel is configured to engage said front tuck flap to at least partially define an additional releasably secure closure of the container in a closed position.

4. The blank of claim 1, further comprising a front tuck flap which includes an offset edge, at least one of said front panel and said first major diagonal panel further comprises a notch, and said notch being configured to receive said offset edge when the container is formed to at least partially define the first releasably secure closure of the container in the closed position.

5. The blank of claim 1, wherein the first top side panel has an arcuate cutout along its lower edge.

6. A container formed from a blank of foldable sheet material, said container comprising:

a top portion comprising a top panel hingedly connected to a first top side panel along a first side edge of said top panel, the first top side panel having a front edge including a portion extending therefrom; and a bottom portion comprising a bottom panel, a first bottom side panel hingedly connected to a first side edge of said bottom panel, a front panel hingedly connected to a front edge of said bottom panel, and a corner portion comprising:

a first minor diagonal panel extending from a front edge of said first bottom side panel;

a first major diagonal panel extending from a first side edge of said front panel, said first major diagonal panel having a length greater than a length of said first minor diagonal panel; and a first corner panel hingedly connected to said first minor and major diagonal panels, said first corner panel overlapping and substantially parallel to said bottom panel, wherein said extending portion contacts said first minor diagonal panel to at least partially define a first releasably secure closure of the container.

7. The container of claim 6, wherein said extending portion is configured to contact said first minor diagonal panel in a friction fit.

8. The container of claim 6, further comprising a front tuck flap extending from a front edge of said top panel, wherein said front panel engages said front tuck flap to at least partially define an additional releasably secure closure of the container in a closed position.

9. The container of claim 8, wherein said front tuck flap further comprises an offset edge, at least one of said front panel and said first major diagonal panel further comprises a notch, and said notch being configured to receive said offset edge when the container is formed to at least partially define the first releasably secure closure of the container in the closed position.

10. The blank of claim 6, wherein the first top side panel has an arcuate cutout along its lower edge.

11. A blank of foldable sheet material for forming a container, said blank comprising:

a top portion comprising a top panel, a front tuck flap extending from a front edge of said top panel, and a first top side panel extending from a first side edge of said top panel;

a bottom portion comprising a bottom panel, a first bottom side panel extending from a first side edge of said bottom panel, a front panel extending from a front edge of said bottom panel, and a corner portion comprising:

a first minor diagonal panel extending from a front edge of said first bottom side panel;

a first major diagonal panel extending from a first side edge of said front panel, said first major diagonal panel having a length greater than a length of said first minor diagonal panel; and a first corner panel hingedly connected to said first minor and major diagonal panels, wherein said front tuck flap further comprises an offset edge, at least one of said front panel and said first major diagonal panel further comprises a notch, and said notch being configured to be open along an upper edge of said at least one of the front panel and first major diagonal panel and to receive said offset edge when the container is formed to at least partially define a first releasably secure closure of the container in the closed position.

12. The blank of claim 11, wherein the first top side panel comprises a front edge including a portion extending therefrom.

13. The blank of claim 12, wherein said extending portion is configured to contact said first minor diagonal panel in a friction fit.

14. The blank of claim 11, wherein the first top side panel has an arcuate cutout along its lower edge.

15. A container formed from a blank of foldable sheet material, said container comprising:

a top portion comprising a top panel hingedly connected to a front tuck flap along a front edge of said top panel and to a first top side panel along a first side edge of said top panel;

a bottom portion comprising a bottom panel, a first bottom side panel hingedly connected to a first side edge of said bottom panel, a front panel hingedly connected to a front edge of said bottom panel, and a corner portion comprising:

a first minor diagonal panel extending from a front edge of said first bottom side panel;

a first major diagonal panel extending from a first side edge of said front panel, said first major diagonal panel having a length greater than a length of said first minor diagonal panel; and a first corner panel hingedly connected to said first minor and major diagonal panels, said first corner panel overlapping and substantially parallel to said bottom panel, wherein said front tuck flap further comprises an offset edge, at least one of said front panel and said first major diagonal panel at its upper edge further comprises a notch open to said upper edge, and said notch receives said offset edge to at least partially define a first releasably secure closure of the container in the closed position.

16. The container of claim 15, wherein the first top side panel comprises a front edge including a portion extending therefrom.

17. The container of claim 16, wherein said extending portion is configured to contact said first minor diagonal panel in a friction fit.

18. The blank of claim 15, wherein the first top side panel has an arcuate cutout along its lower edge.

19. The blank of claim 1, said extending portion configured to contact said first minor diagonal panel without engaging any opening formed in the blank, to at least partially define a first releasably secure closure of the container in the closed position.

20. The container of claim 6, wherein said extending portion contacts said first minor diagonal panel without engaging any opening cut in the first minor diagonal panel, to at least partially define a first releasably secure closure of the container.

* * * * *